US009937472B2

(12) United States Patent
May et al.

(10) Patent No.: US 9,937,472 B2
(45) Date of Patent: Apr. 10, 2018

(54) ASSEMBLY OPERABLE TO MIX OR SPARGE A LIQUID

(71) Applicant: Techmetals Incorporated, Dayton, OH (US)

(72) Inventors: Michael May, Dayton, OH (US); Phillip Daniel Brockman, Dayton, OH (US)

(73) Assignee: Techmetals, Inc., Dayton, OH (US)

( * ) Notice: Subject to any disclaimer, the term of this patent is extended or adjusted under 35 U.S.C. 154(b) by 238 days.

(21) Appl. No.: 14/706,366

(22) Filed: May 7, 2015

(65) Prior Publication Data

US 2016/0325241 A1 Nov. 10, 2016

(51) Int. Cl.
*B01F 3/04* (2006.01)
*B01F 3/08* (2006.01)

(52) U.S. Cl.
CPC ..... *B01F 3/04248* (2013.01); *B01F 3/0861* (2013.01); *B01F 3/0865* (2013.01); *B01F 2003/04276* (2013.01); *B01F 2003/04297* (2013.01)

(58) Field of Classification Search
CPC .. B01F 2003/04312; B01F 2003/04297; B01F 3/04248; B01F 3/0865; B01F 3/0861
See application file for complete search history.

(56) References Cited

U.S. PATENT DOCUMENTS 3,064,680 A 11/1962 Winslow, Jr.
3,881,701 A 5/1975 Schoenman et al.
4,557,879 A * 12/1985 Weber ..... B01F 3/04248 261/122.1
4,605,626 A * 8/1986 Beck ..... C12M 41/36 204/212
5,080,868 A * 1/1992 Elgas ..... B01L 3/5082 261/122.1
5,887,977 A 3/1999 Morikawa
(Continued)

FOREIGN PATENT DOCUMENTS

DE 3433018 A1 * 3/1986 ..... B01F 3/04262
DE 4240300 A1 * 6/1994 ..... B01F 3/0412
(Continued)

*Primary Examiner* — Amber R Orlando
*Assistant Examiner* — Stephen Hobson
(74) *Attorney, Agent, or Firm* — Ulmer & Berne LLP

(57) ABSTRACT

A mixer-sparger assembly includes a first body portion; a second body portion; a gasket positioned between the first and second body portions to form a seal between the two body portions; an inlet disposed in the first body portion; a flexible tube connected to the inlet; a fluid chamber disposed in the first body portion or the second body portion and in fluidic communication with the inlet; an outlet disposed in the first body portion or the second body portion and in fluidic communication with the fluid chamber; and a plurality of supports extending downwardly from the second body portion to form a self-standing assembly with a space disposed below the second body portion. The first and second body portions have a density greater than about 1.0 g/cm$^3$, and the inlet, fluid chamber, and outlet in spatial combination are configured to have an axis of rotational symmetry.

13 Claims, 13 Drawing Sheets

(56) References Cited

U.S. PATENT DOCUMENTS

| | | | | |
|---|---|---|---|---|
| 6,264,176 | B1 * | 7/2001 | Dickman | B01F 3/0412 210/221.2 |
| 6,280,078 | B1 | 8/2001 | Lewis | |
| 7,100,954 | B2 * | 9/2006 | Klein | H01L 21/6838 294/64.3 |
| 7,192,562 | B1 | 3/2007 | Towler et al. | |
| 7,770,814 | B2 * | 8/2010 | Archambeau | A01G 25/00 239/142 |
| 7,909,502 | B2 | 3/2011 | Ehrfeld et al. | |
| 8,057,677 | B2 | 11/2011 | Schanz et al. | |
| 8,302,941 | B2 | 11/2012 | Nakashima et al. | |
| 9,005,971 | B2 * | 4/2015 | Goodwin | B01F 3/04269 261/122.1 |
| 9,567,246 | B2 * | 2/2017 | Ko | C02F 3/201 |
| 9,643,133 | B2 * | 5/2017 | Goodwin | B01F 15/0085 |
| 9,643,140 | B2 * | 5/2017 | Ramirez | B01F 11/02 |
| 2011/0304063 | A1 * | 12/2011 | Ko | B01F 3/04262 261/77 |
| 2012/0234394 | A1 * | 9/2012 | Seletzky | B01F 3/04248 137/3 |
| 2015/0182977 | A1 * | 7/2015 | Park | B01F 3/04241 261/77 |

FOREIGN PATENT DOCUMENTS

| | | | | |
|---|---|---|---|---|
| DE | 202015106563 | U1 * | 1/2016 | C02F 1/00 |
| EP | 407180 | B1 | 1/1995 | |
| WO | WO-9219546 | A1 * | 11/1992 | B01F 3/04269 |
| WO | WO-2008013349 | A1 * | 1/2008 | B28B 1/08 |
| WO | WO-2012063995 | A1 * | 5/2012 | B01F 3/04269 |
| WO | WO-2014199525 | A1 * | 12/2014 | B01F 5/0256 |
| WO | WO-2015065647 | A1 * | 5/2015 | B01F 7/22 |

* cited by examiner

ASSEMBLY OPERABLE TO MIX OR SPARGE A LIQUID

DETAILED DESCRIPTION

Figure 1:
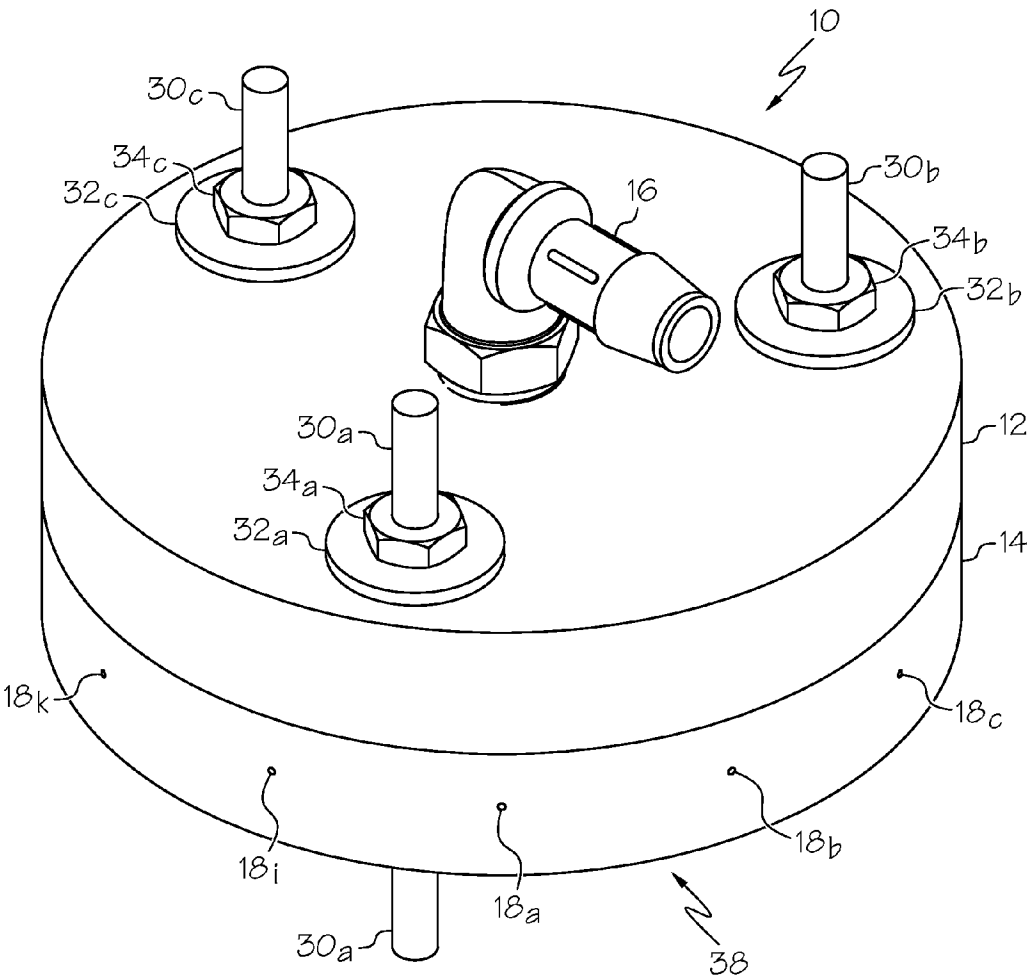
FIG. 1 is an isometric view of an embodiment of a mixer-sparger device.
Figure 2:
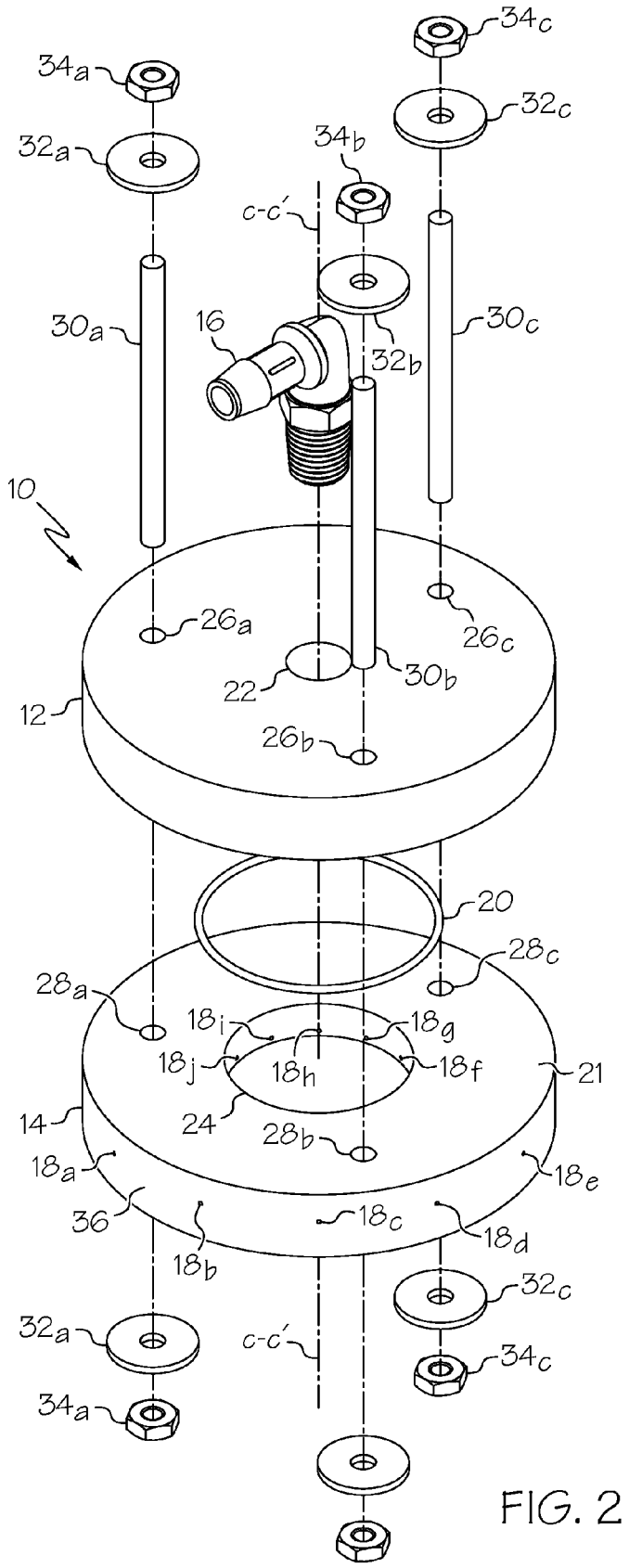
FIG. 2 is an exploded view of the mixer-sparger device of FIG. 1.
Figure 3:
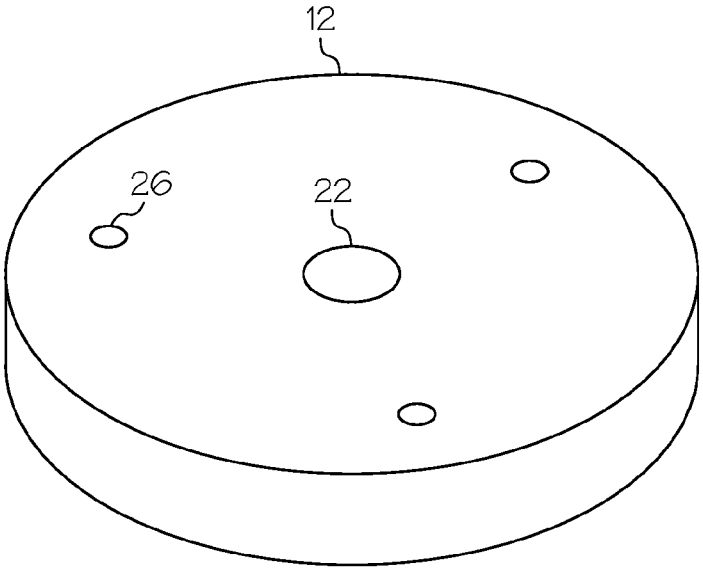
FIG. 3 is an isometric view of a first body portion of the mixer-sparger device of FIG. 1.
Figure 4:
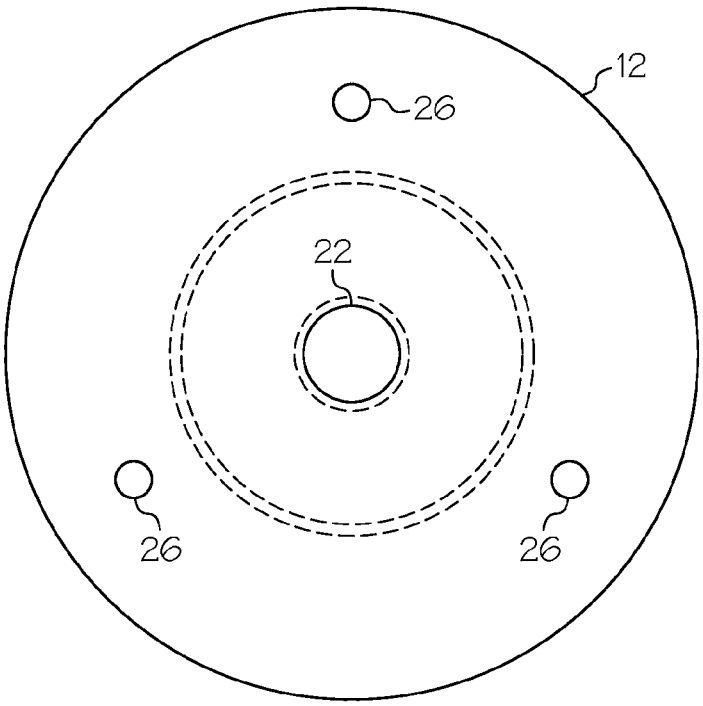
FIG. 4 is a top plan view of the first body portion of FIG. 3.
Figure 5:
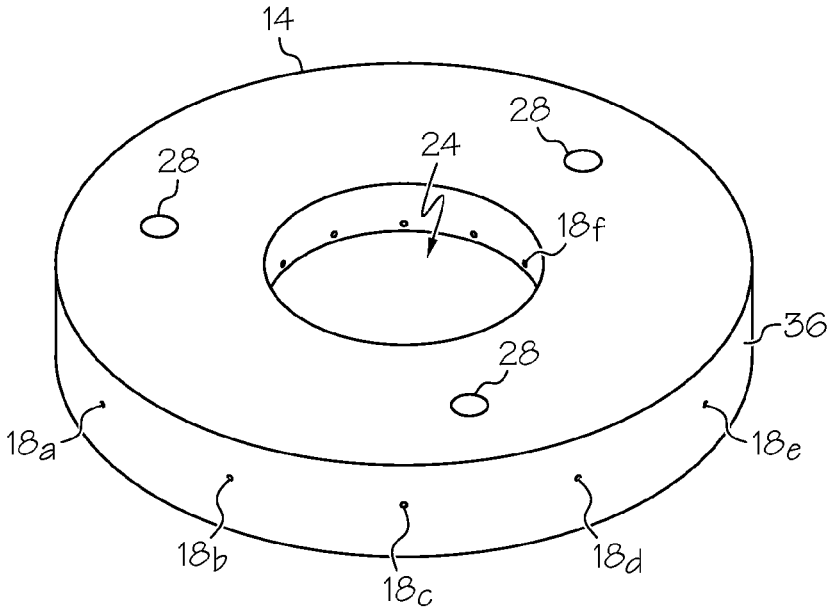
FIG. 5 is an isometric view of a second body portion of the mixer-sparger device of FIG. 1.
Figure 6:
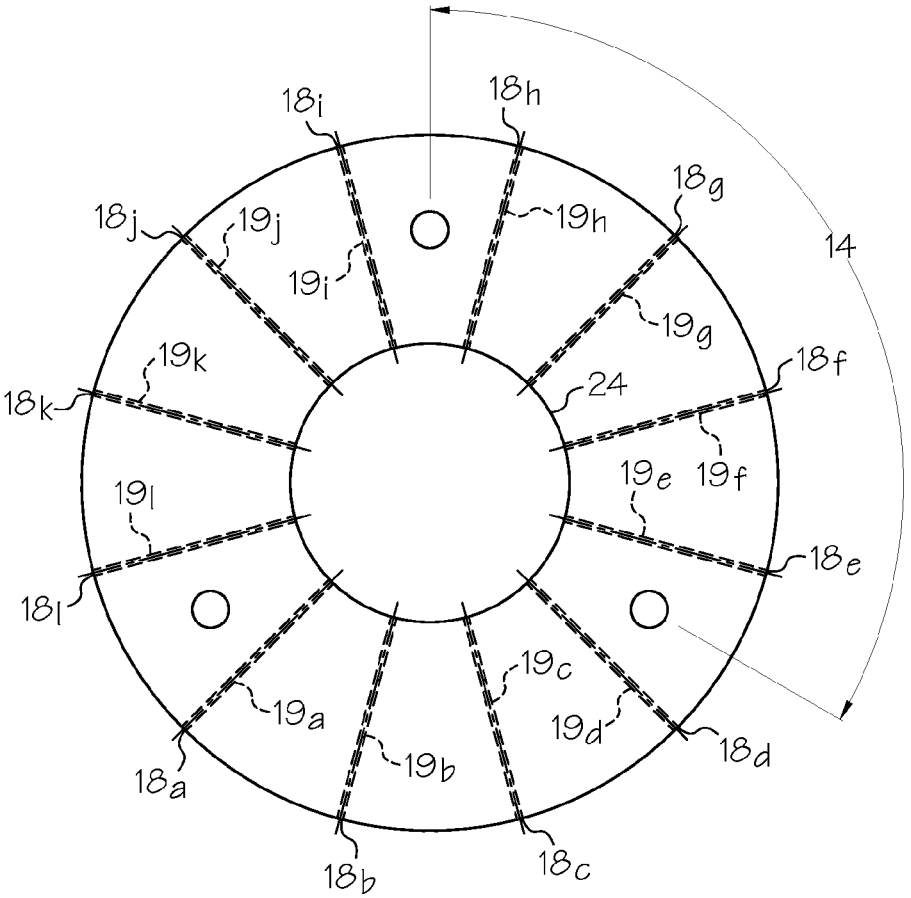
FIG. 6 is a top plan view of the second body portion of FIG. 5.
Figure 7:
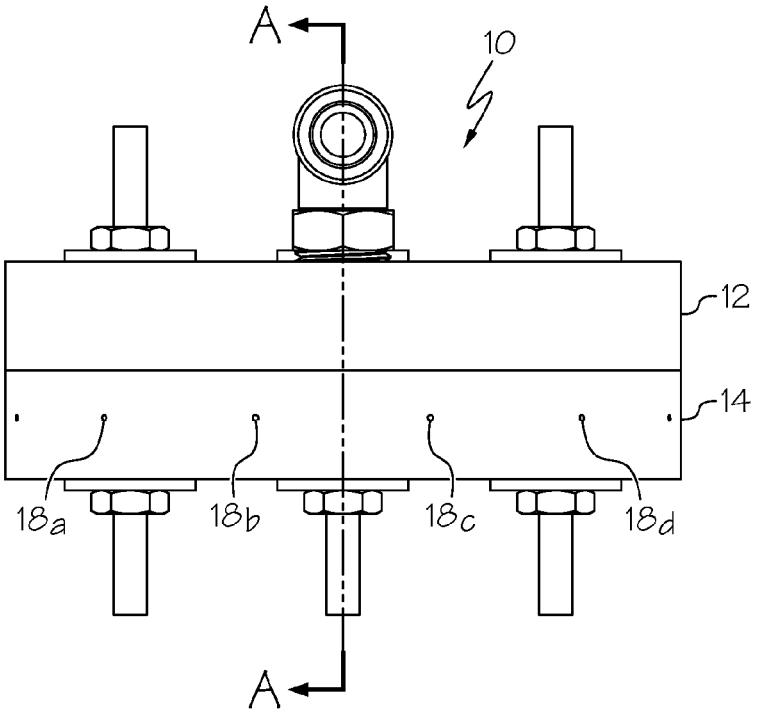
FIG. 7 is a side elevational view of the mixer-sparger device of FIG. 1.
Figure 8:
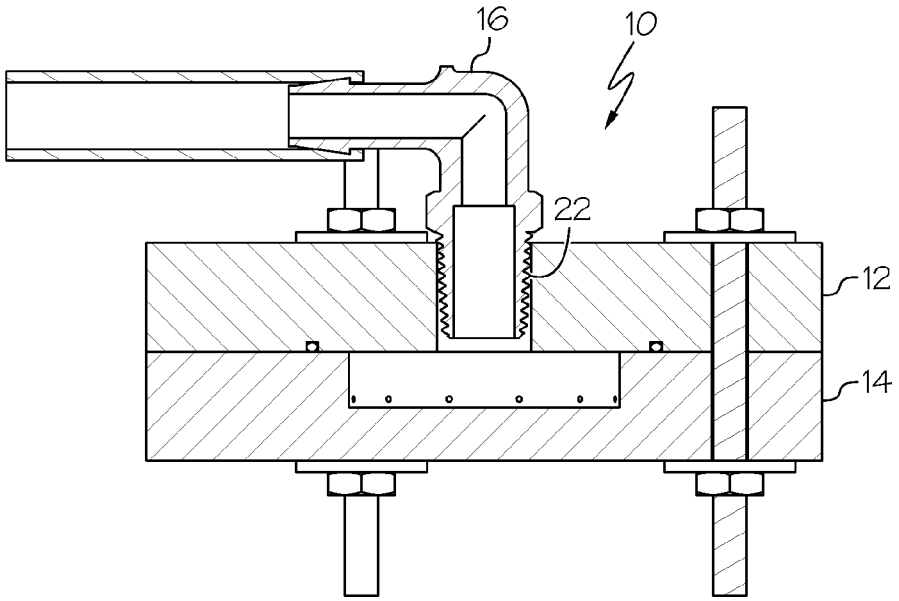
FIG. 8 is a cross sectional view of the mixer-sparger device of FIG. 7, taken along line A-A.
Figure 9:
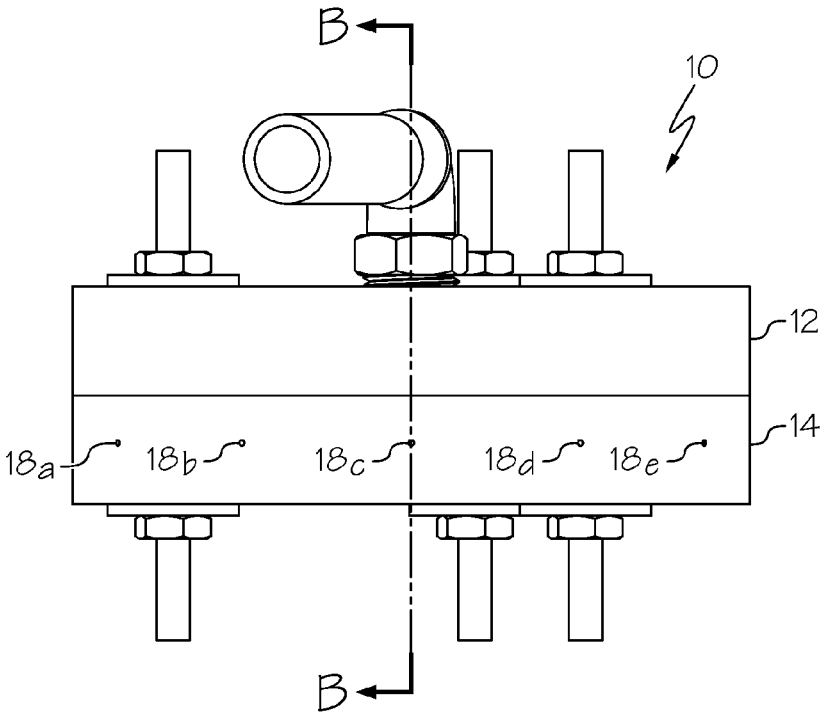
FIG. 9 is a side elevational view of the mixer-sparger device of FIG. 1.

The following text sets forth a broad description of numerous different embodiments. The description is to be construed as exemplary only and does not describe every possible embodiment since describing every possible embodiment would be impractical, if not impossible, and it will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims.

It should also be understood that, unless a term is expressly defined in this specification using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). No term is intended to be essential unless so stated. To the extent that any term recited in the claims at the end of this patent is referred to in this patent in a manner consistent with a single meaning, that is done for sake of clarity only so as to not confuse the reader, and it is not intended that such a claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Referring to FIGS. 1-10, an embodiment of an assembly operable to mix or sparge a liquid such as, for example, a plating bath (hereinafter, "a mixer-sparger assembly") is shown as 10. The mixer-sparger assembly 10 includes a first body portion 12, a second body portion 14 detachably connected to the first body portion 12, an inlet 22 disposed within the first body portion 12, one or more outlets 18 in fluid communication with the inlet 22, and a gasket 20 disposed between the first and second body portions forming a sealed connection between the two body portions.

As shown, in this example, the inlet 22 is coaxially disposed about a central axis c-c' of the assembly 10. Additionally, the assembly 10 includes a chamber 24 disposed within the second body portion 14 and is also coaxially disposed about the central axis c-c'. In some embodiments, the chamber 24 is formed into or by at least the second body portion. In such an embodiment, the chamber 24 may be machined into at least the second body portion 14. The outlet 18 includes twelve (12) outlets **18*a*-18*l* that extend radially from the chamber 24 to a peripheral surface 36 of the second body portion 14. Also, the outlets 18*a*-18*l*** are disposed equal radial distances apart from one another about the central axis.

A portion of the inlet 22 may be threaded to threadingly receive an inlet connector 16 or inlet tube. In some embodiments one end of the inlet connector 16 is connected to the inlet 22 and an opposite end of the connector 16 connects to a flexible tube (not shown) such as, for example, flexible polymeric tubing, rubber tubing, or the like. In some embodiments, the flexible tube may comprise fluoroelastomers (FKM) as defined in ASTM D1418 such as, for example, Viton®, polytetrafluoroethylene (PTFE), perfluoro-elastomers (FFKM), tetrafluoro ethylene/propylene rubbers (FEPM), any combinations thereof, and the like. The flexible tube acts as an inlet channel to channel the incoming fluid into the inlet connector 16 and ultimately into the inlet 22.

In this example, the first body portion 12 includes three (3) holes **26*a*-26*c* disposed through the first body portion an equal angular value apart from each other about the central axis (e.g., 120 degrees). These holes 26*a*-26*c* are configured to receive respective connection bolts or screws 30*a*-30*c*. The second body portion 14 also may include three (3) holes 28*a*-28*c* disposed through the second body portion an equal angular value apart from each other about the central axis (e.g., 120 degrees). As shown, for example, in FIG. 2, when the first and second body portions 12 and 14, respectively, are brought together the holes 26*a*-26*c* of the first body are aligned with the holes 28*a*-28*c*, respectively. Three (3) connection bolts 30*a*-30*c* are inserted and slid through a respective set of holes 26*a*/28*a*, 26*b*/28*b*, and 26*c*/28*c*. Once slid into the respective holes a respective set of washers 32 are slid onto both ends of each connection bolt and then a respective set of nuts 34 are threadingly engaged onto both ends of each connection bolt, connecting the first body portion 12 to the second body portion 14**. A variety of other connection or attachment mechanisms may be used to connect the first body portion and second body portion together, including but not limited to, clamps, screws, adhesives, welds, combinations thereof, or the like.

As shown in FIG. 1, the connection bolts 30*a*-30*c* may extend axially downward from a bottom surface of the second body portion 14 to support the assembly. In such a configuration, the assembly 10 is a self-supporting assembly. In some embodiments, the assembly 10 may be supported by the connection bolts 30*a*-30*c* such that a space 38 is created below such assembly 10. As will be described in greater detail below, the space 38 may, in some embodiments, accommodate a stirring device underneath the assembly 10. In some embodiments, the supports may be one or more members that are not the bolts, which extend downwardly from the assembly 10.

When assembled, the inlet connector 16 is fluidically connected to the inlet 22, which is fluidically connected to the chamber 24, which is fluidically connected to each of the twelve (12) outlets 18*a*-18*l*. As such, a fluid such as, for example, a gas (e.g., air) or a liquid (e.g., water) may flow into the inlet connector 16 through the inlet 22 into the chamber 24 and then into and through each of the outlets 18*a*-18*l*, exiting the second body portion 14 in a radial direction about the central axis into the surrounding environment of the assembly 10 such as, for example, a plating bath within a beaker or plating bath tub.

Figure 10:
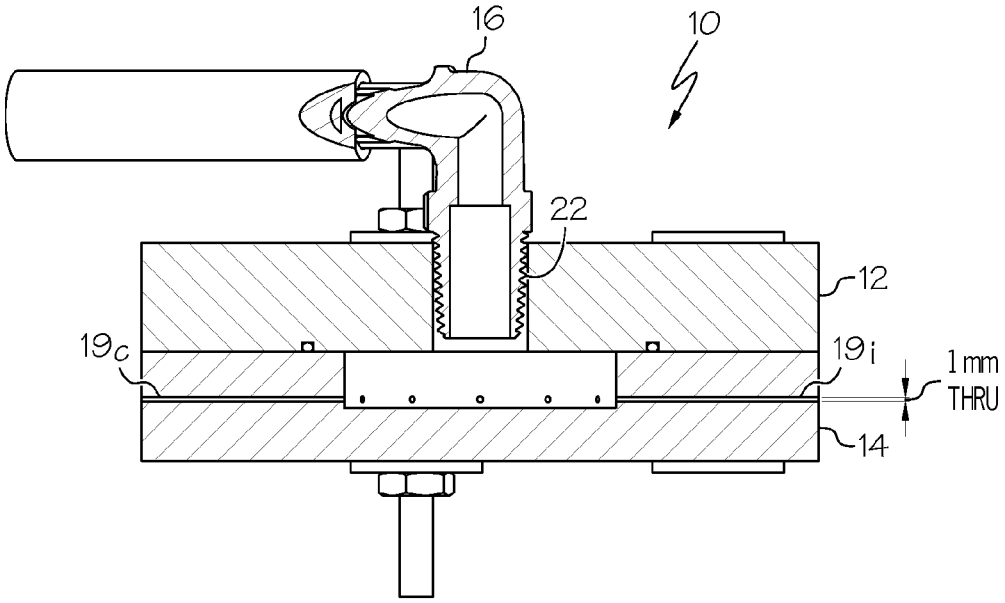
FIG. 10 is a cross sectional view of the mixer-sparger device of FIG. 9, taken along line B-B.
Figure 11:
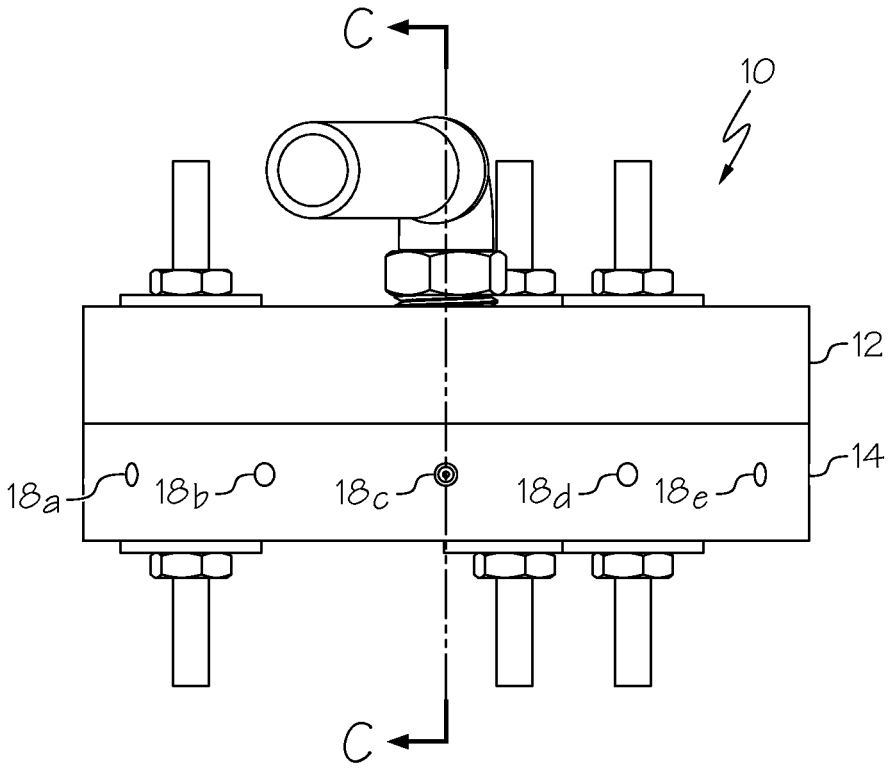
FIG. 11 is a side elevational view of the mixer-sparger device of FIG. 1.
Figure 12:
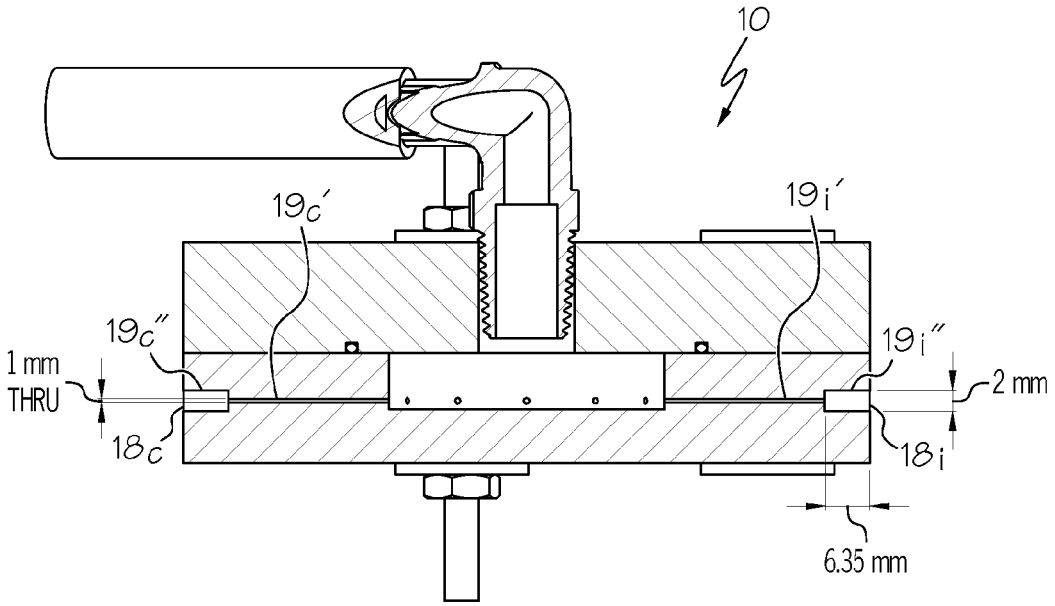
FIG. 12 is a cross sectional view of the mixer-sparger device of FIG. 11, taken along line C-C.
Figure 13:
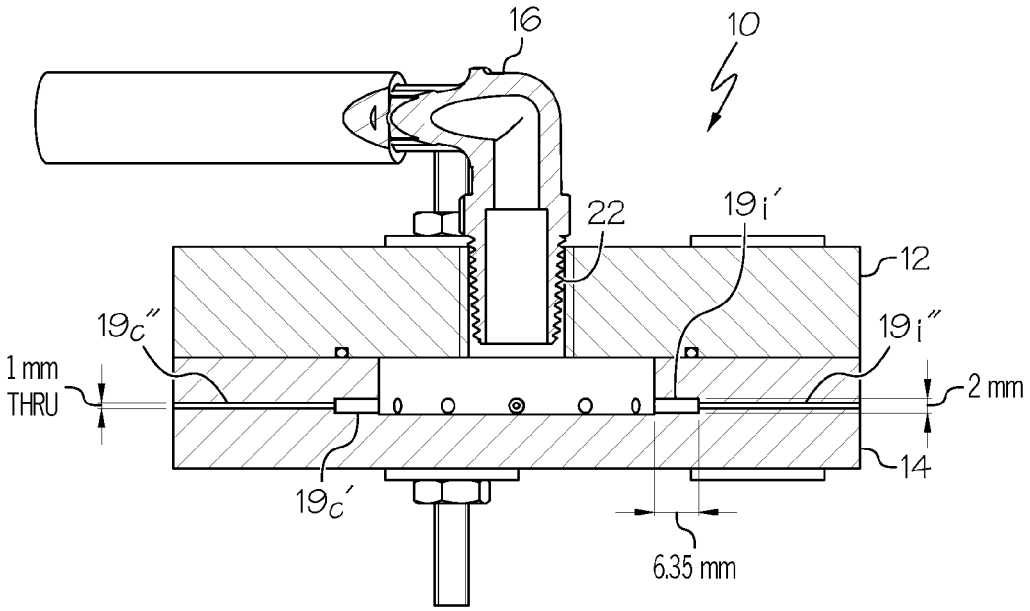
FIG. 13 is a cross sectional view of the mixer-sparger device of FIG. 11, taken along line C-C.

In this embodiment, the diameter of the outlets 18*a*-18*l* may stay constant along the entire length of the outlets from the chamber 24 to the exit at the peripheral surface 36 as shown in FIG. 10. In some embodiments, the opening of the outlets 18*a*-18*l* may be counterbored or similarly smoothed. In some embodiments, the diameter of one or more of the outlets 18*a*-18*l* may decrease along the length of the one or more outlets 18*a*-18*l* from the chamber 24 to the exit at the peripheral surface 36, to create a nozzle or nozzle effect such as shown in, for example, FIG. 13. In some embodiments, the diameter of the outlets 18*a*-18*l* may increase along the length of the one or more outlets 18*a*-18*l* from the chamber 24 to the exit at the peripheral surface 36 such as shown, for example, in FIG. 12. In some embodiments, the diameter of the outlets 18*a*-18*l* may decrease and then increase or increase and then converge along the length of the one or more outlets 18*a*-18*l* from the chamber 24 to the exit at the peripheral surface 36. Also, one or more of the outlets 18*a*-18*l* may have a variety of cross sectional shapes such as, for example, circular, oval, rectangular, triangular, etc.

Any of these decreasing or increasing diameters of the outlets may start at any point along the outlets and extend for any length along such outlets. Other configurations of the outlets may be used as well. Although an optional feature, in the embodiment shown in FIGS. 1-13, the inlet 22, chamber 24, and outlets 18*a*-18*l* are positioned about the first and second body portions 12 and 14, respectively, such that the inlet 22, chamber 24, and outlets 18*a*-18*l* in spatial combination have an axis of rotational symmetry. In this embodiment, the axis of rotational symmetry is the central axis c-c'. In some embodiments, the one or more outlets 18 (e.g., outlets 18*a*-18*l*) may also include internal threading, external threading, or other connector assemblies to allow an external nozzle, eductor, or the like to be threaded or connected to the one or more outlets 18 (e.g., outlets 18*a*-18*l*).

Additionally, in the embodiments of FIGS. 1-13, the outlets 18*a*-18*l* are shown to extend radially through the second body portion 14 parallel to the upper surface 21 of the second body portion 14. However, such outlets may run at any angle relative to the second body portion such as, for example 90 degrees, 60 degrees, 45 degrees, 30 degrees, 20 degrees, 10 degrees, or any angle therebetween, and at any angle relative to one another. It is also understood that the inlet 22 and outlet 18 may comprise any number of inlets and outlets in any number of configurations in, through, and/or about any of the first and/or second body portions.

Any of the components of the assembly 10 shown and described above may be removed, interchanged with other components, combined into an integral unit, or arranged in a different orientation and/or location. In other words, the assembly 10 is modular with respect to its construction.

Figure 14:
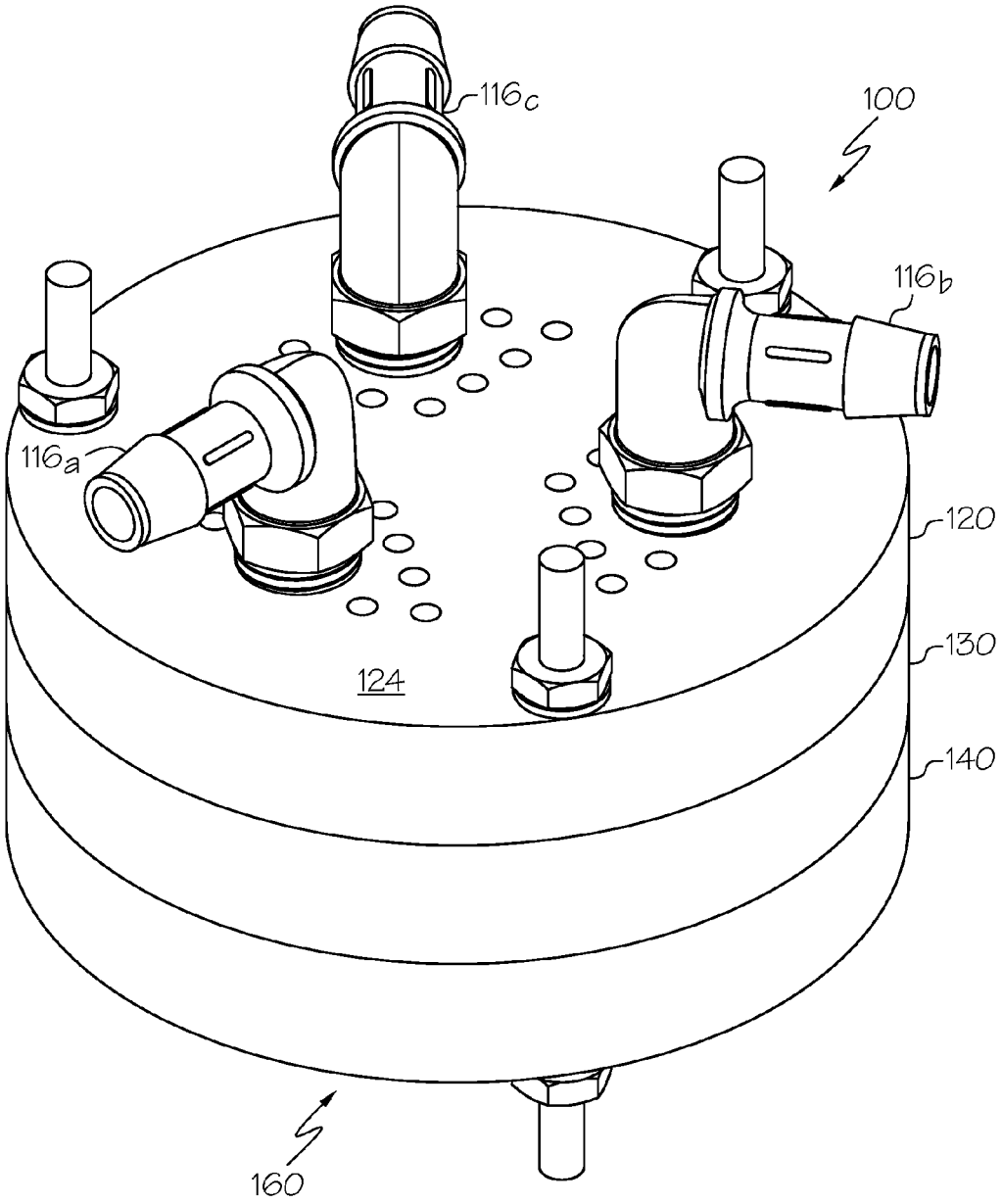
FIG. 14 is an isometric view of another embodiment of a mixer-sparger device.
Figure 15:
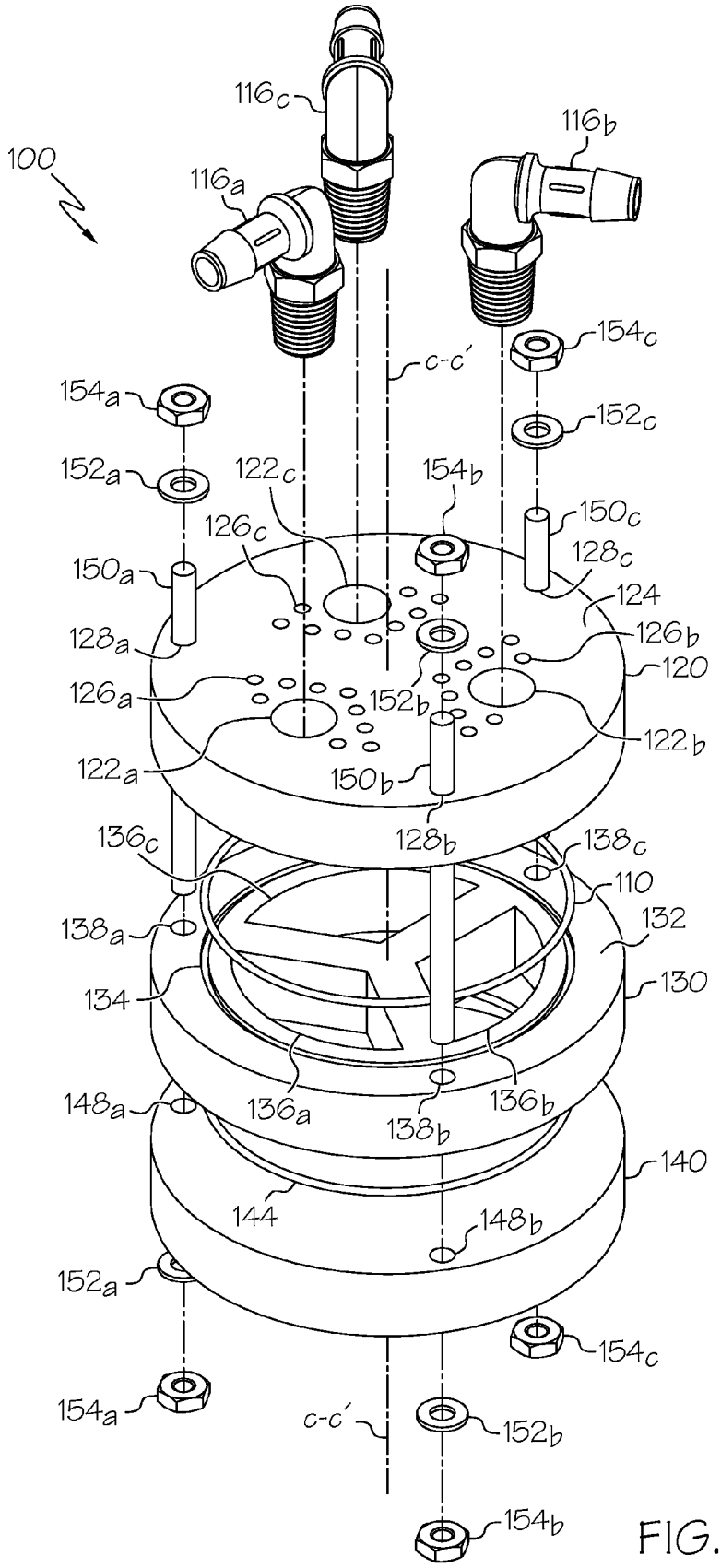
FIG. 15 is an exploded view of the mixer-sparger device of FIG. 14.
Figure 16:
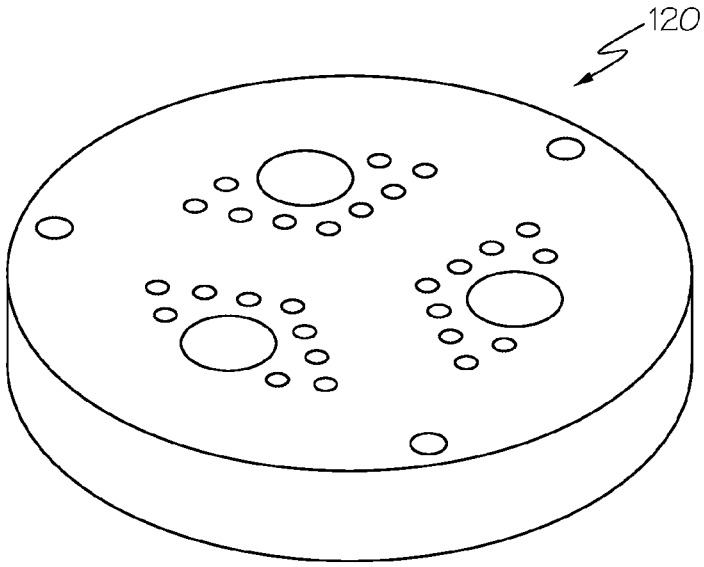
FIG. 16 is an isometric view of a first body portion of the mixer-sparger device of FIG. 14.
Figure 17:
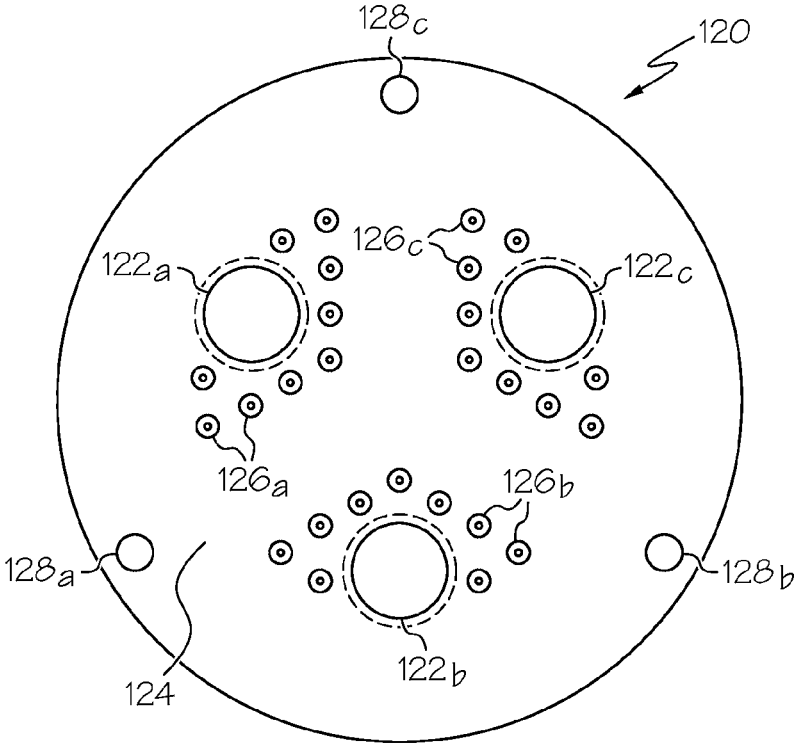
FIG. 17 is a top plan view of the first body portion of FIG. 16.
Figure 18:
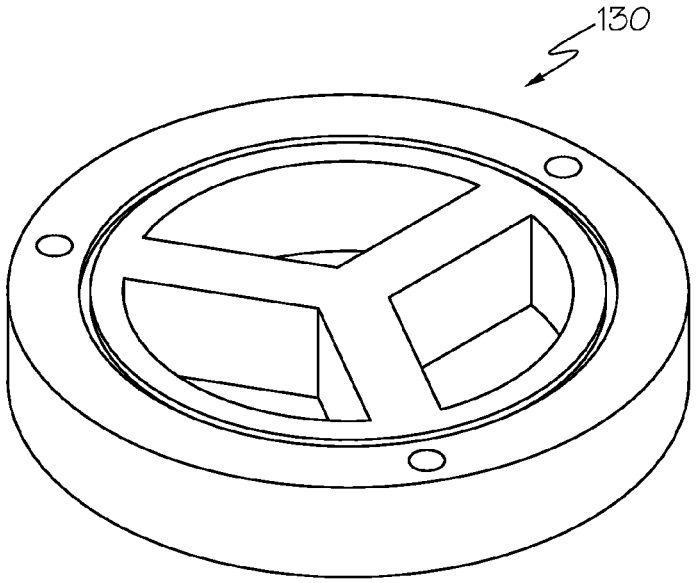
FIG. 18 is an isometric view of a second body portion of the mixer-sparger device of FIG. 14.
Figure 19:
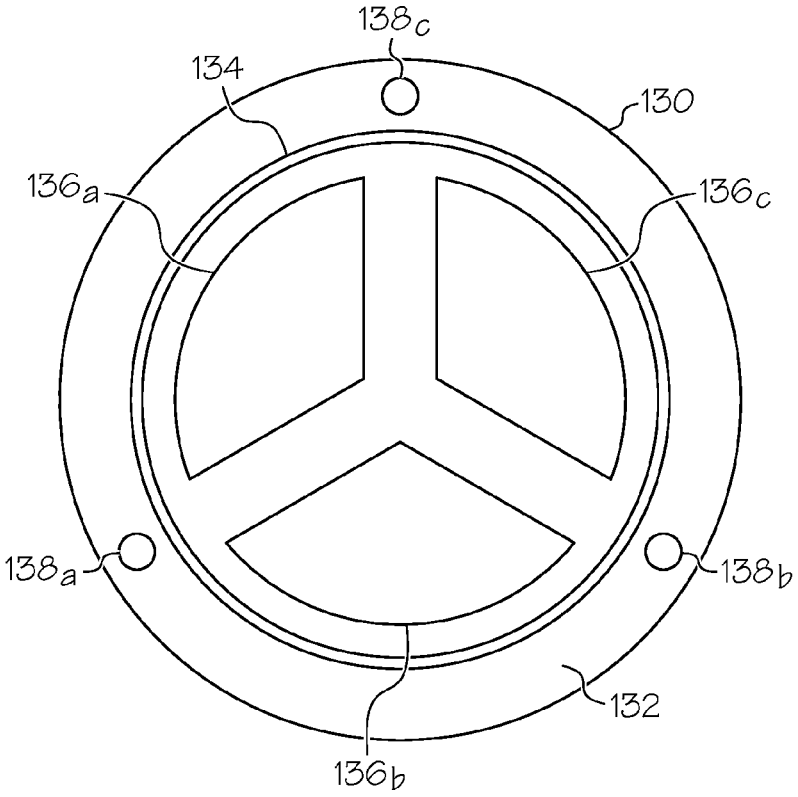
FIG. 19 is a top plan view of the second body portion of FIG. 18.
Figure 20:
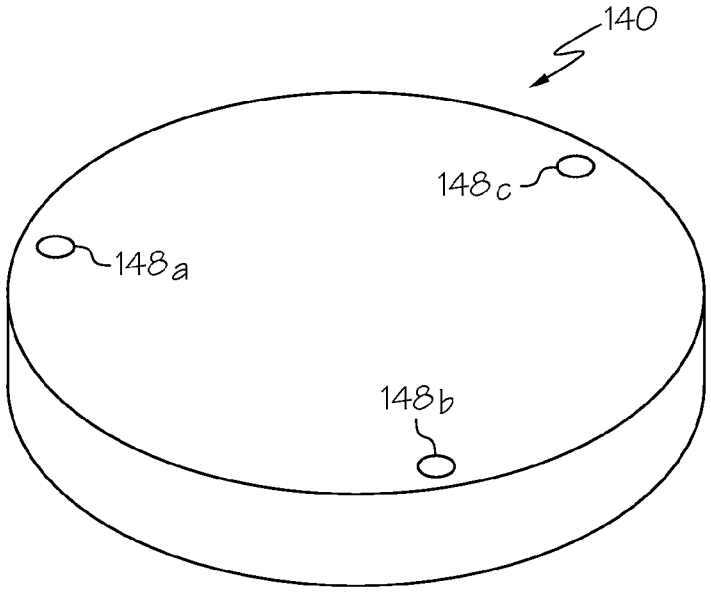
FIG. 20 is an isometric view of a third body portion of the mixer-sparger of FIG. 14.
Figure 21:
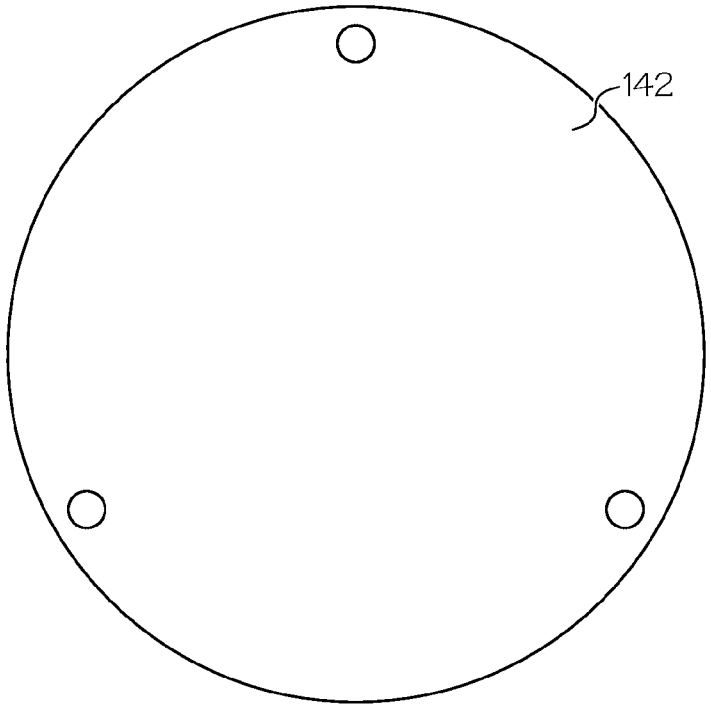
FIG. 21 is a top plan view of the third body portion of FIG. 20.

Referring to FIGS. 14-21, another embodiment of an assembly operable to mix or sparge a liquid (hereinafter, "mixer-sparger assembly") is shown as mixer-sparger assembly 100. The assembly 100 includes a first body portion 120, a second body portion 130, a third body portion 140, three (3) inlets 122*a*-122*c* disposed in and through the first body portion 120, and twenty-seven (27) outlets 126 disposed in and through the first body portion 120. In this embodiment, the twenty-seven (27) outlets are clustered into three groups of nine (9) outlets 126*a*, 126*b*, and 126*c*, respectively. The sets of outlets 126*a*, 126*b*, 126*c* are disposed in a pattern (substantially diamond-shaped) about the respective inlets 122*a*, 122*b*, 122*c*. In FIG. 15, the inlets 122*a*-122*c* and the outlets 126 extend axially through the entire height of the first body portion 120 (i.e., parallel to the central axis c-c' of the assembly 100). Both the inlets and outlets may be disposed along and about the first body portion 120, the second body portion 130, and/or the third body portion 140 in any pattern, grouping, or random dispersion.

The second body portion 130 may include an annular gasket seat 134 that is configured to receive a first gasket 110 such that the first gasket 110 may form a seal between the first and second body portions 120 and 130, respectively, when they are connected or attached together. In addition, the second body portion 130 may include a first chamber 136*a*, a second chamber 136*b*, and a third chamber 136*c* disposed in the second body portion 130 about the central axis c-c'. In some embodiments, the three chambers may be disposed completely through the second body portion 130. In some embodiments, the three chambers are formed into and/or through the second body portion 130. In some embodiments, the chambers may be machined into and through the second body portion 130 or only into a portion of the second body portion 130. In such an embodiment, the third body portion 140, when connected or attached to the second body portion 130, acts as a bottom wall to the chambers 136*a*-136*c*, and the first body portion 120, when connected or attached to the second body portion 130, acts as a top wall to the chambers.

In some embodiments, the three chambers may be disposed or formed into the second body portion 130, but not all the way through such that at least a portion of the second body portion 130 may act as a bottom wall to each of the chambers, thus eliminating the need for the third body portion 140 if not desired. It is understood that any number of chambers may be formed within the assembly in one or more of the body portions. Also, it is understood that if a larger chamber(s) is desired, the first body portion 120 and/or the third body portion 140 may also be formed to include or form a portion of the chamber volume as well. Moreover, any number of additional body portions such as, a fourth body portion, fifth body portion, etc., may be added to the assembly and formed to include or form a portion of the chamber(s). In some embodiments, one or more of the body portions may be formed to include a chamber(s) such that the body portion or portions may be annular-in-shape.

As shown in FIG. 15, a second gasket 144 that is positioned between the second body portion 130 and the third body portion 140 such that when the body portions are brought together and connected to one another the second gasket 144 forms a seal between the second and third body portions 130 and 140, respectively.

A portion of each of the inlets 122*a*-122*c* may be threaded to threadingly receive a respective one of the inlet connectors 116*a*-116*c* or an inlet tube. In some embodiments one end of each of the inlet connectors 116*a*-116*c* is connected to the respective inlets 122*a*-122*c* and an opposite end of each of the connectors 116*a*-116*c* connects to a flexible tube (not shown) such as, for example, flexible polymeric tubing, rubber tubing, or the like. The flexible tubing may be three separate and distinct tubes or one tube that branches into three tubes to that connect to each of the three inlet connectors 116*a*-116*c*, respectively. In some embodiments, the flexible tube may comprise fluoroelastomers (FKM) as defined in ASTM D1418 such as, for example, Viton®, polytetrafluoroethylene (PTFE), perfluoro-elastomers (FFKM), tetrafluoro ethylene/propylene rubbers (FEPM), any combinations thereof, and the like. In some embodiments, the flexible tubing acts to channel the incoming fluid into the respective inlet connectors 116*a*-116*c*, and ultimately into the respective inlets 122*a*-122*c*. In some embodiments, flexible inlet tubes may be used for plating processes to enable the assembly 10 or the assembly 100 to be rapidly repositioned within the process vessel by grabbing the flexible tube(s) from a position above the process vessel.

In this embodiment, the first body portion 120 also includes three holes 128*a*-128*c* disposed through it. The second body portion 130 includes three holes 138*a*-138*c* disposed through it. Finally, the third body portion 140 includes three holes 148*a*-148*c* disposed through it. These holes 128*a*/138*a*/148*a*, 128*b*/138*b*/148*b*, and 128*c*/138*c*/148*c* are disposed 120 degrees apart from each other about the central axis c-c' of their respective body portions 120/130/140. When the first, second, and third body portions 120, 130, and 140, respectively, are brought together to be connected or attached to one another, these holes 128*a*/138*a*/148*a*, 128*b*/138*b*/148*b*, and 128*c*/138*c*/148*c* are aligned with each other such that a respective connection bolt or screw 150*a*-150*c* may be slid into and through such respective, aligned holes 128*a*/138*a*/148*a*, 128*b*/138*b*/148*b*, and 128*c*/138*c*/148*c* within the three body portions 120/130/140.

Once slid into the respective holes a respective set of washers 152*a*-152*c* are slid onto both ends of each connection bolt 150*a*-150*c*, respectively, and then a respective set of nuts 154*a*-*c* are threadingly engaged onto both ends of each connection bolt, connecting the first body portion 120, second body portion 130, and third body portion 140 together. The connection bolts 150*a*-150*c* may be completely threaded or just have a sufficient amount of their lengths at each end threaded in order that the nuts 154*a*-*c* may be tightened down onto the respective surfaces of the first and third body portions 120 and 140. A variety of other connection or attachment mechanisms may be used to connect the first body portion and third body portion together (thus sandwiching the second body portion in between the first and third body portions), including but not limited to, clamps, screws, adhesives, welds, combinations thereof, or the like.

As shown in FIG. 14, the connection bolts 150*a*-150*c* may extend axially downward from a bottom surface of the third body portion 140 to support the assembly 100. In such a configuration, the assembly may be supported by the connection bolts such that a space 160 may be created below such assembly 100. As will be described in greater detail below, the space 160 may, in some embodiments, accommodate a stirring device underneath the assembly 100. In some embodiments, the supports may be one or more members that are not the bolts, which extend downwardly from the assembly 100.

The inlets 122*a*-122*c* may be configured to receive a respective inlet connector 116*a*-116*c* or an inlet tube (not shown) directly. As shown, a first inlet connector 116*a* is threadingly received by the first inlet 122*a*, a second inlet connector 116*b* is threadingly received by the second inlet 122*b*, and a third inlet connector 116*c* is threadingly received by the third inlet 122*c*.

When assembled, the first inlet connector 116*a* is fluidically connected to the first inlet 122*a*, which is fluidically connected to the first chamber 136*a*, which is fluidically connected to each of the nine (9) outlets in the first outlet set 126*a*. As such, a fluid may flow into the inlet connector 116*a* through the inlet 122*a* into the chamber 136*a* and then into and through each of the outlets 126*a*, exiting the first body portion 120 in an axial direction into the surrounding environment of the assembly 100 such as, for example, a plating bath within a beaker or plating bath tub. Also, the second inlet connector 116*b* is fluidically connected to the second inlet 122*b*, which is fluidically connected to the second chamber 136*b*, which is fluidically connected to each of the nine (9) outlets in the second outlet set 126*b*. As such, a fluid may flow into the inlet connector 116*b* through the inlet 122*b* into the chamber 136*b* and then into and through each of the outlets 126*b*, exiting the first body portion 120 in an axial direction into the surrounding environment of the assembly 100. Additionally, the third inlet connector 116*c* is fluidically connected to the first inlet 122*c*, which is fluidically connected to the third chamber 136*c*, which is fluidically connected to each of the nine (9) outlets in the third outlet set 126*c*. As such, a fluid may flow into the inlet connector 116*c* through the inlet 122*c* into the chamber 136*c* and then into and through each of the outlets 126*c*, exiting the first body portion 120 in an axial direction into the surrounding environment of the assembly 100 such as, for example, a plating bath within a beaker or plating bath tub.

Although an optional feature, in the embodiment shown in FIGS. 14-21, the three (3) inlets 122*a*-122*c*, three (3) chambers 136*a*-136*c*, and three (3) outlet sets 126*a*-126*c* are positioned about one or more of the body portions such that the assembly 100 has a symmetry element about the central axis c-c'. In some embodiments, the three (3) inlets 122*a*-122*c*, three (3) chambers 136*a*-136*c*, and three (3) outlet sets 126*a*-126*c* are positioned about one or more of the body portions such that the three (3) inlets 122*a*-122*c*, three (3) chambers 136*a*-136*c*, and three (3) outlet sets 126*a*-126*c* in spatial combination have an axis of rotational symmetry. In this embodiment, the axis of rotational symmetry is the central axis c-c'. In some embodiments shown and described herein, rotational symmetry of the fluid inlet(s), chamber(s), and outlet(s) (e.g., inlets 22, 122*a*-122*c*, chambers 24, 136*a*-136*c*, and outlets 18*a*-18*l*, 126*a*-126*c*) may minimize the fluid path length through the assembly and thereby minimize frictional energy losses of the fluid.

In this embodiment, the diameter of the outlets in each of the three outlet sets 126*a*-126*c* may stay constant along the entire length of the outlets from the respective chambers 136*a*-136*c* to the exit at an upper surface 124 of the first body portion 120. In some embodiments, the outlet in each of the three outlet sets 126*a*-126*c* may be counterbored or similarly smoothed. In some embodiments, the diameter of one or more of the outlets within one or more of the outlets sets 126*a*-126*c* may decrease along the length of the one or more outlets from the respective chamber 136*a*-136*c* to the exit at the upper surface 124, to create a nozzle or nozzle effect. In some embodiments, the diameter of one or more of the outlets of one or more of the outlet sets 126*a*-126*c* may increase along the length of the outlet(s) from the respective chamber 136*a*-136*c* to the exit at the upper surface 124. In some embodiments, the diameter of one or more of the outlets of the one or more outlet sets 126*a*-126*c* may decrease and then increase or increase and then decrease along the length of the outlet(s) from the respective chamber 136*a*-136*c* to the exit at the upper surface 124. Also, one or more of the outlets of the one or more outlet sets 126*a*-126*c* may have a variety of cross sectional shapes such as, for example, circular, oval, rectangular, triangular, etc.

Any of these decreasing or increasing diameters of the outlets may start at any point along the outlets and extend for any length along such outlets. Other 100, including the inlets 122*a*-122*c*, chambers 136*a*-136*c*, and outlets 126*a*-126*c*, has rotational symmetry about the central axis c-c'. In some embodiments, the one or more outlets (e.g., outlets 126*a*-126*c*) may also include internal threading, external threading, or other connector assemblies to allow an external nozzle, eductor, or the like to be threaded or connected to the one or more outlets (e.g., outlets 126*a*-126*c*).

Additionally, in this embodiment, the outlets 126*a*-126*c* are shown to extend axially through the first body portion 120 parallel to the central axis c-c'. However, such outlets may run at any angle relative to the central axis such as, for example 90 degrees, 60 degrees, 45 degrees, 30 degrees, 20 degrees, 10 degrees, or any angle therebetween, and at any angle relative to one another. It is also understood that the inlet 122 and outlet set 126 may comprise any number of inlets and outlets in any number of configurations in, through, and/or about any of the first, second, and/or third body portions.

Any of the components of the assembly 100 shown and described above may be removed, interchanged with other components, combined into an integral unit, or arranged in a different orientation and/or location. In addition, any components or features of the assembly 100 may be combined or modified to combine with the assembly 10 or vice versa.

In some embodiments, an agitator may be positioned under the assembly 10 or 100 within the respective space 38 or 160 to agitate the bath. In some embodiments, the agitator includes a magnetic paddle wheel having any number of paddles or blades. A coupled magnetic actuator may be positioned underneath and outside of the bath container (e.g., glass beaker) adjacent the magnetic paddle wheel in order to actuate the magnetic paddle wheel within the bath.

The body portions and/or other components shown and described herein, including but not limited to first body portion 12, second body portion 14, first body portion 120, second body portion 130, and/or third body portion 140, may be fabricated from a variety of materials, including but not limited to metal, plastic, glass, ceramic, composite material, or the like. In some embodiments, the body portions and/or other components of the assembly 10, 100 may consist of a variety of polymers. Illustrative polymers that may be used to fabricate the body portions and/or other components shown and described herein include, but are not limited to, fluorocarbon polymers such as, for example, polytetrafluoroethylene (PTFE), perfluoroalkoxy alkane (PFA), polychlorotrifluoroethylene (PCTFE) ethylene tetrafluoroethylene (ETFE), fluorinated ethylene propylene (FEP), or the like. In some embodiments, the body portions and/or other components may be fabricated from any fluorocarbon polymer that has a density of greater than about 1.1 g/cm$^3$, in some embodiments greater than 1.5 g/cm$^3$, in some embodiments greater than 1.8 g/cm$^3$, or in some embodiments about 2 g/cm$^3$. In some embodiments, the fluorocarbon polymers may have the densities as set forth above and/or be substantially resistant to chemical reactions, particularly resistant to chemically reacting with electrochemical and/or chemical process baths, including but not limited to plating baths.

In some embodiments, the body portions and/or other components shown and described herein, including but not limited to first body portion 12, second body portion 14, first body portion 120, second body portion 130, and/or third body portion 140, may be fabricated from polyether ether ketone (PEEK) or other similar organic thermoplastic polymers. In some embodiments, the body portions and/or other components shown and described herein, including but not limited to first body portion 12, second body portion 14, first body portion 120, second body portion 130, and/or third body portion 140, may be fabricated from polyvinylidene fluoride (PVDF), chlorinated polyvinyl chloride (CPVC), polyetherimide, or the like.

In some embodiments, the body portions and/or other components shown and described herein, including but not limited to first body portion 12, second body portion 14, first body portion 120, second body portion 130, and/or third body portion 140, may be fabricated from polymers that have a density that is greater than the density of water such as, for example, greater than about 0.9975415 g/cm$^3$ (at approximately room temperature, 23° C.) and/or substantially resistant to chemical reactions, particularly chemically resistant to chemically reacting with electrochemical and/or chemical process baths. In some embodiments, the body portions and/or other components shown and described herein, including but not limited to first body portion 12, second body portion 14, first body portion 120, second body portion 130, and/or third body portion 140, may be fabricated from polymers that have a density that is greater than the density of a plating bath (e.g., naturally submersible within the plating bath) such as, for example, greater than about 1.1 g/cm$^3$, in some embodiments greater than 1.5 g/cm$^3$, in some embodiments greater than 1.8 g/cm$^3$, or in some embodiments about 2 g/cm$^3$. In some embodiments, the polymers used to fabricate the body portions and/or other components of the assembly may have the densities as set forth above and/or be substantially resistant to chemical reactions, particularly resistant to chemically reacting with electrochemical and/or chemical process baths, including but not limited to plating baths.

In some embodiments, the gasket 20, first gasket 110, and/or the second gasket 144 may be fabricated from any material that is substantially resistant to chemical reactions, particularly chemically resistant to chemically reacting with electrochemical and/or chemical process baths, including but not limited to plating baths. In some embodiments, the gasket 20, first gasket 110, and/or the second gasket 144 may be fabricated from fluoroelastomers (FKM) as defined in ASTM D1418 such as, for example, Viton®, and/or other fluorocarbon elastomers. In some embodiments, the gasket 20, first gasket 110, and/or the second gasket 144 may be fabricated from polytetrafluoroethylene (PTFE). Other illustrative polymers that may be used to fabricate the gaskets include, but are not limited to, perfluoro-elastomers (FFKM) and tetrafluoro ethylene/propylene rubbers (FEPM), perfluoroalkoxy alkane (PFA), polychlorotrifluoroethylene (PCTFE), ethylene tetrafluoroethylene (ETFE), fluorinated ethylene propylene (FEP), polyvinylidene fluoride (PVDF), or the like.

The connection bolts 30*a*-30*c*/150*a*-150*c*, washers 32*a*-32*c*/152*a*-152*c*, and/or nuts 34*a*-34*c*/154*a*-154*c* may be fabricated from a variety of materials such as, for example, metals, polymers, composites, and/or combinations thereof. In some embodiments, the bolts, washers and/or nuts are fabricated from one or more materials that are substantially resistant to chemical reactions, particularly resistant to chemically reacting with electrochemical and/or chemical process baths, including but not limited to plating baths. In some embodiments, any of a number of the bolts, washers and/or nuts are fabricated from fluorocarbons, polyether ether ketone (PEEK), polytetrafluoroethylene (PTFE), perfluoroalkoxy alkane (PFA), ethylene tetrafluoroethylene (ETFE), fluorinated ethylene propylene (FEP), polychlorotrifluoroethylene (PCTFE), polyvinylidene fluoride (PVDF), chlorinated polyvinyl chloride (CPVC), polyetherimide, titanium, titanium alloy, cobalt chromium alloys (e.g., cobalt-chromium-molybdenum alloys), stainless steel, Hastelloy®, any combination thereof, or the like.

In some embodiments, a kit includes a first body portion such as, for example, first body portion 12. However, the first body portion 12 in this embodiment does not include an inlet such as, for example, inlet 22, disposed therein. In some embodiments, the first body portion 12 does not include an inlet or an outlet disposed therein. The first body portion 12 comprises a solid plate of material which may include any of the material described above herein. The kit includes a second body portion such as, for example, second body portion 14. However, the second body portion 14 does not include an outlet 18 (e.g., outlets 18*a*-18*l*) or a chamber such as, for example, the chamber 24 disposed therein. In some embodiments, the second body portion 14 does not include an inlet or an outlet disposed therein. In some embodiments, the kit may include the chamber 24 pre-machined within the second body portion 14, but not include an inlet or outlet disposed therein. The second body portion 14 comprises a solid plate of material which may include any of the material described above herein. The kit further includes a gasket 20 and one or more connection mechanisms as shown and described above herein. In some embodiments, the kit may further include an inlet connector 16 and/or a flexible tube of any length. In some embodiments, the kit may include any number of additional body portions that are either blank, i.e., no holes or chambers pre-drilled or machined therein, or pre-drilled or pre-machined with any number of inlets, outlets, channels, chambers, and/or in any number of configurations, including the embodiments set above herein.

In some embodiments, the kit may include the inlet (e.g., inlet 22), outlet (e.g., outlet 18*a*-18*l*), and/or chamber (e.g., chamber 24) pre-drilled and/or pre-machined in the first body portion (e.g., first body portion 12), second body portion (e.g., second body portion 14), and/or a third body portion. The inlet may be pre-threaded to receive an inlet connector such as, for example, inlet connectors 16. In some embodiments of the kit, the first body portion (e.g., first body portion 12), second body portion (e.g., second body portion 14), and/or third body portion may include one or more holes such as, for example, holes 26*a*-26*c*, 28*a*-28*c*, pre-drilled in one or more of the body portions to receive a connection bolt or screw such as, for example, bolts 30*a*-30*c*. The kit may also include one or more washers such as, for example, washers 32*a*-32*c*, that are configured to slide onto the bolts and one or more nuts such as, for example, nuts 34*a*-34*c*, that are configured to threadingly engage the bolts.

In some embodiments, a kit includes a first body portion such as, for example, first body portion 12, wherein the first body portion 12 is pre-drilled with an inlet 22 that is internally threaded. The first body portion 12 comprises a solid plate of material which may include any of the material described above herein. The kit includes a second body portion such as, for example, second body portion 14. However, the second body portion 14 does not include an outlet 18 (e.g., outlets 18*a*-18*l*) or a chamber such as, for example, the chamber 24 disposed therein. In some embodiments, the kit may include the chamber 24 pre-machined within the second body portion 14. The second body portion 14 comprises a solid material which may include any of the materials described above herein. The kit further includes a gasket 20, an inlet connector such as, for example, inlet connector 16, and/or one or more connection mechanisms as shown and described above herein. In some embodiments, the kit may further include a flexible tube of any length.

In some embodiments, a kit includes a first body portion such as, for example, first body portion 120. However, the first body portion 120 in this embodiment does not include an inlet such as, for example, inlet 122*a*-122*c*, or an outlet (e.g., outlets 126*a*-126*c*) disposed therein. The first body portion 120 comprises a solid plate of material which may include any of the material described above herein. The kit includes a second body portion such as, for example, second body portion 130. The second body portion 130 comprises a solid plate of material which may include any of the material described above herein. However, the second body portion 140 does not include a chamber such as, for example, the chambers 136*a*-136*c*, an inlet, or outlet disposed therein. The kit may include a third body portion such as, for example, third body portion 140. The third body portion 140 comprises a solid plate of material which may include any of the materials described above herein. In this embodiment, the third body portion 140 does not include an inlet, an outlet, or a chamber disposed therein. In some embodiments, the kit may include one or more connection mechanisms as shown and described above herein.

In some embodiments, the kit may include the inlet (e.g., inlets 122*a*-122*c*), outlet (e.g., outlets 126*a*-126*c*), and/or chamber (e.g., chambers 136*a*-136*c*) pre-drilled and/or pre-machined in the first body portion (e.g., first body portion 120), second body portion (e.g., second body portion 130), and/or third body portion (e.g., third body portion 140). The inlet may be pre-threaded to receive an inlet connector such as, for example, inlet connectors 116*a*-116*c*. In some embodiments of the kit, the first body portion (e.g., first body portion 120), second body portion (e.g., second body portion 130), and/or third body portion (e.g., third body portion 140) may include one or more holes such as, for example, holes 128*a*-128*c*, 138*a*-138*c*, 148*a*-148*c*, pre-drilled in one or more of the body portions to receive a connection bolt or screw such as, for example, bolts 150*a*-150*c*. The kit may also include one or more washers such as, for example, washers 152*a*-152*c*, that are configured to slide onto the bolts and one or more nuts such as, for example, nuts 154*a*-154*c*, that are configured to threadingly engage the bolts.

In some embodiments, the kit further includes a first gasket such as, for example, gasket 110, a second gasket such as, for example, second gasket 144. In some embodiments, the kit may further include an inlet connector such as, for example, inlet connectors 116*a*-116*c*, and/or a flexible tube of any length. In some embodiments, the kit may include any number of additional body portions that are either blank, i.e., no holes or chambers pre-drilled or machined therein, or pre-drilled or pre-machined with any number of inlets, outlets, chambers, and/or in any number of configurations, including the embodiments set above herein.

In some embodiments, a kit includes a first body portion such as, for example, first body portion 120, wherein the first body portion 120 is pre-drilled with the three (3) inlets 122*a*-122*c*, which are all internally threaded. However, the first body portion 120 does not include an inlet or the outlet (e.g., outlets 126*a*-126*c*) pre-drilled therein. The kit includes a second body portion such as, for example, second body portion 130, wherein the second body portion is pre-machined to include three (3) separate chambers 136*a*-136*c*, but does not include an inlet or outlet predrilled therein. The kit further includes a third body portion 140, but does not include an inlet or outlet predrilled therein. The first body portion (e.g., first body portion 120), second body portion (e.g., second body portion 130), and/or third body portion (e.g., third body portion 140) may include three holes 128*a*-128*c*, 138*a*-138*c*, 148*a*-148*c* pre-drilled in the body portions to receive a respective connection bolt 150*a*-150*c*. The kit may include six (6) washers 152*a*-152*c* and six nuts 154*a*-154*c*.

It is understood that other illustrative kits may include a kit wherein one or more of the components are removed, replaced with one or more components from one of the other illustrative kits, and/or added to one of the illustrative kits.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any embodiment disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present disclosure have been illustrated and described, it would be obvious to those skilled in the art that various other changes and modifications can be made. It is therefore intended to cover in the appended claims all such changes and modifications.

What is claimed is:

1. A mixer-sparger assembly, comprising:

a first body portion;

a second body portion;

a gasket positioned between the first and second body portions to form a seal between the first and second body portions;

an inlet disposed in the first body portion, wherein the inlet comprises a first inlet, a second inlet and a third inlet, each disposed within the first body portion and spaced-apart equally about a central axis;

a flexible tube connected to the inlet;

a fluid chamber formed within the second body portion and in fluidic communication with the inlet, wherein the fluid chamber comprises a first chamber, a second chamber and a third chamber disposed within the second body portion and spaced-apart equally about the central axis, and wherein each of the inlets are in fluidic communication with a respective one of the chambers;

an outlet disposed in the first body portion or the second body portion and in fluidic communication with the fluid chamber; and a plurality of supports extending downwardly from the second body portion to form a self-standing assembly with a space disposed below the second body portion;

wherein the first and second body portions are comprised of a polymeric material having a density greater than about 1.0 g/cm$^3$ and the inlet, fluid chamber, and outlet in a spatial combination are configured to have an axis of rotational symmetry.

2. The assembly of claim 1, wherein the polymeric material is selected from the group consisting of polytetrafluoroethylene (PTFE), perfluoroalkoxy alkane (PFA), polychlorotrifluoroethylene (PCTFE), ethylene tetrafluoro ethylene (ETFE), fluorinated ethylene propylene (FEP), polyether ether ketone (PEEK), polyvinylidene fluoride (PVDF), chlorinated polyvinyl chloride (CPVC), and polyetherimide.

3. The assembly of claim 1, wherein the first body portion and the second body portion are joined together with the gasket there between.

4. The assembly of claim 3, wherein the axis of rotational symmetry is about the central axis of the assembly.

5. The assembly of claim 4, wherein the outlet is formed within the second body portion and extends from the chamber to an outer surface of the second body portion.

6. The assembly of claim 5, wherein the outlet comprises a plurality of outlet channels extending from the chamber to a peripheral surface of the second body portion.

7. The assembly of claim 6, wherein the plurality of outlet channels comprises twelve outlet channels formed within the second body portion, and wherein each of the twelve channels extends radially from the chamber to the peripheral surface.

8. The assembly of claim 1, wherein the outlet comprises a plurality of outlet channels formed within the first body portion.

9. The assembly of claim 8, wherein the plurality of outlet channels comprises a first plurality of outlet channels, a second plurality of outlet channels, and a third plurality of outlet channels formed within the first body portion, wherein the first plurality of outlet channels extends from the first chamber to an upper surface of the first body portion, the second plurality of outlet channels extends from the second chamber to the upper surface, and the third plurality of outlet channels extends from the third chamber to the upper surface.

10. The assembly of claim 9, wherein the first plurality of outlet channels are disposed adjacent to the first inlet, the second plurality of outlet channels are disposed adjacent to the second inlet, and the third plurality of outlet channels are disposed adjacent to the third inlet.

11. The assembly of claim 10, further comprising a third body portion connected to the second body portion and a second gasket positioned between the second body portion and the third body portion to form a seal between the second and third body portions.

12. The assembly of claim 11, wherein the first, second, and third chambers are each formed completely through the second body portion such that a top wall of each of the three chambers is formed by the first body portion, a side wall of each of the three chambers is formed by the second body portion, and a bottom wall of each of the three chambers is formed by the third body portion.

13. The assembly of claim 9, wherein the first plurality of outlet channels includes nine outlet channels, the second plurality of outlet channels includes nine outlet channels, and the third plurality of outlet channels includes nine outlet channels.

* * * * *